United States Patent [19]

Rutsche et al.

[11] 4,397,244

[45] Aug. 9, 1983

[54] OFFICE FURNITURE

[75] Inventors: Wendolin Rutsche, Ruti; Urs Langenegger, Hittnau, both of Switzerland

[73] Assignee: Embru-Werke, Mantel & CIE, Ruti, Switzerland

[21] Appl. No.: 211,032

[22] Filed: Nov. 28, 1980

[51] Int. Cl.[3] ..... A47F 5/12

[52] U.S. Cl. ..... 108/6; 108/1; 248/188.2; 248/242

[58] Field of Search ..... 108/1, 2, 5, 6, 144, 108/136; 248/371, 188.2, 221.2, 286, 178, 185, 242; 312/312

[56] References Cited

U.S. PATENT DOCUMENTS

| | | | |
|---|---|---|---|
| 120,604 | 11/1971 | Wibbert | 108/1 |
| 1,876,172 | 9/1932 | Ruddy | 108/1 X |
| 2,599,642 | 6/1952 | Kato | 108/136 |
| 2,767,950 | 10/1956 | Bellon et al. | 108/1 X |
| 2,931,685 | 4/1960 | Butler | 312/312 X |
| 3,875,872 | 4/1975 | Kayner | 108/1 |

*Primary Examiner*—James T. McCall

*Attorney, Agent, or Firm*—Kinzer, Plyer, Dorn & McEachran

[57] ABSTRACT

Two lateral parts (1) interconnected by an upper support (21) are provided in an office furniture unit, with an adjustable table top (22) being arranged between said lateral parts. The adjustment of the table top in the tilt and vertically is accomplished by lateral and posterior pin engagements (35 and/or 32). A bolt (28) which is positioned for reciprocal movement is arranged in the posterior edge (26) of the table top (22). The head (54) of the bolt (28) grips behind a vertical slot (38) of the support (21). Upon disengagement of the table top for its adjustment, it remains connected to the support via the bolt so that it cannot drop out.

8 Claims, 10 Drawing Figures

1
2
3
4
5
6
7
8
9
10
11
12
13
14
15
16
16a
17
18
19
20
21
22
23
39
40
61
62

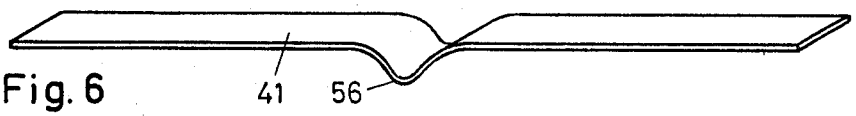
Fig. 6
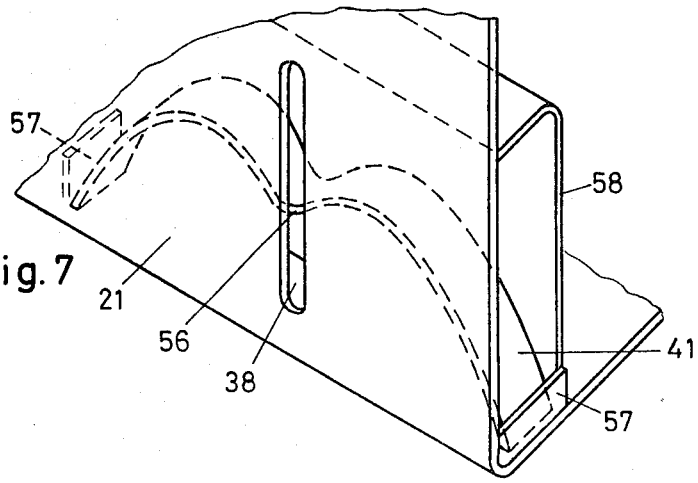
Fig. 7
Fig. 8
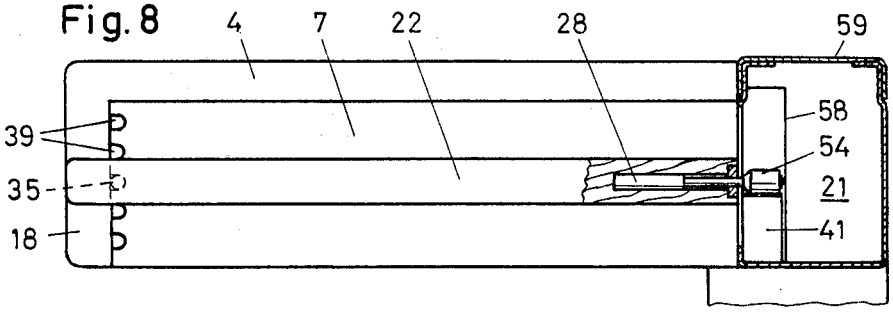
Fig. 9
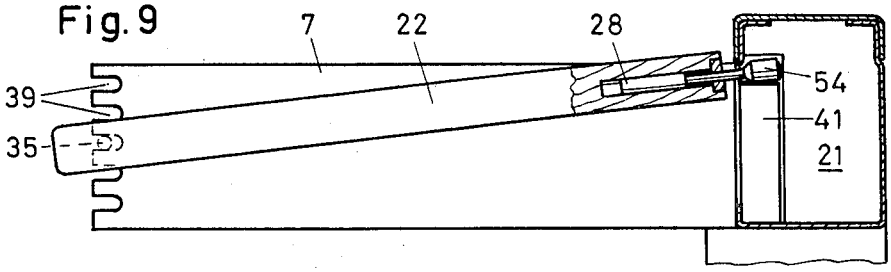
Fig. 10
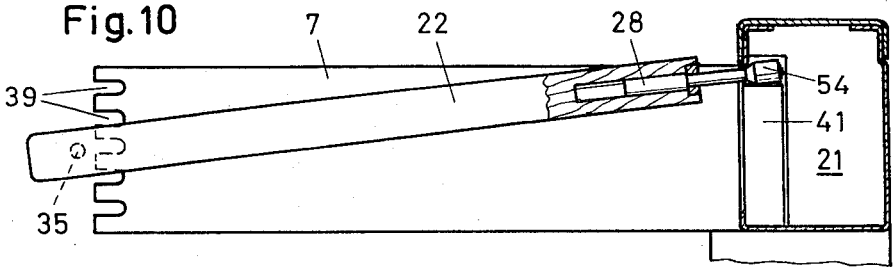

OFFICE FURNITURE

The invention relates to a furniture item with an adjustable table top which is arranged between two lateral parts interconnected by an upper support.

For moderen operating station design office furniture units are used nowadays which are built up from several basic elements and which can be assembled and dismantled in modular design. In the case of desks and office tables the table tops must, commensurate with the requirements of the corresponding operating station and the function, be adjustable vertically and in inclination.

It is known in conventional office furniture units to accomplish the table top adjustment by means of gears, lever systems, air cylinders, hydraulic devices, etc. The mechanics necessary for this purpose are rather expensive and only serve their purpose if and when the table tops must be adjusted frequently, but normally this is not the case.

Simple pin engagements are less expensive for the adjustment, but they are afflicted with various disadvantages. In most cases the pin engagement is complicated in its handling, the furniture units are unstable and the pins frequently are not secured, so that the table tops may shift or even drop out.

The invention now poses the problem of avoiding the mentioned disadvantages and to create a safe, easy to manage table top adjustment which can be manufactured favorably from a cost point of view. According to the invention this is done in such a manner that protruding pins are anchored in the posterior and lateral edges of the table top, each of these pins being engaged in one of several superimposed recesses in the support and in the lateral parts in a removable manner, and that a bolt positioned for reciprocal movement and protruding located in the rear edge of the table top undercuts with its head a vertical slot of the support, all this so that during disengagement of the top for its adjustment, it remains suspended over the bolts in the support.

The head of the bolt appropriately rests on a spring which is accommodated in the interior of the support. During the disengagement of the table top for vertical or inclination adjustment, part of the weight thus is compensated by the spring.

Each lateral part of the item of furniture appropriately is provided with a carrier arm protruding forwardly, with grooves open on one side and arranged superimposed being placed in the forefront of this arm. They are used to receive the protruding lateral pins of the table top. The lateral parts bear a removable cover panel which secures the pins in the grooves and thus prevents the shifting or dropping out of the table top.

BRIEF DESCRIPTION OF THE DRAWINGS

Embodiments of the invention are explained below in greater detail, by way of the drawings.

FIG. 6 shows the leaf spring for the table top support in unbiased condition;

FIG. 7 shows in perspective a cutout from the central area of the connecting support with the leaf spring in biased condition drawn in broken lines; and FIGS. 8 to 10 represent a section along line VIII—VIII according to FIG. 3, showing different possibilities of the vertical and tilt adjustment of the table top.

Figures 1, 2:
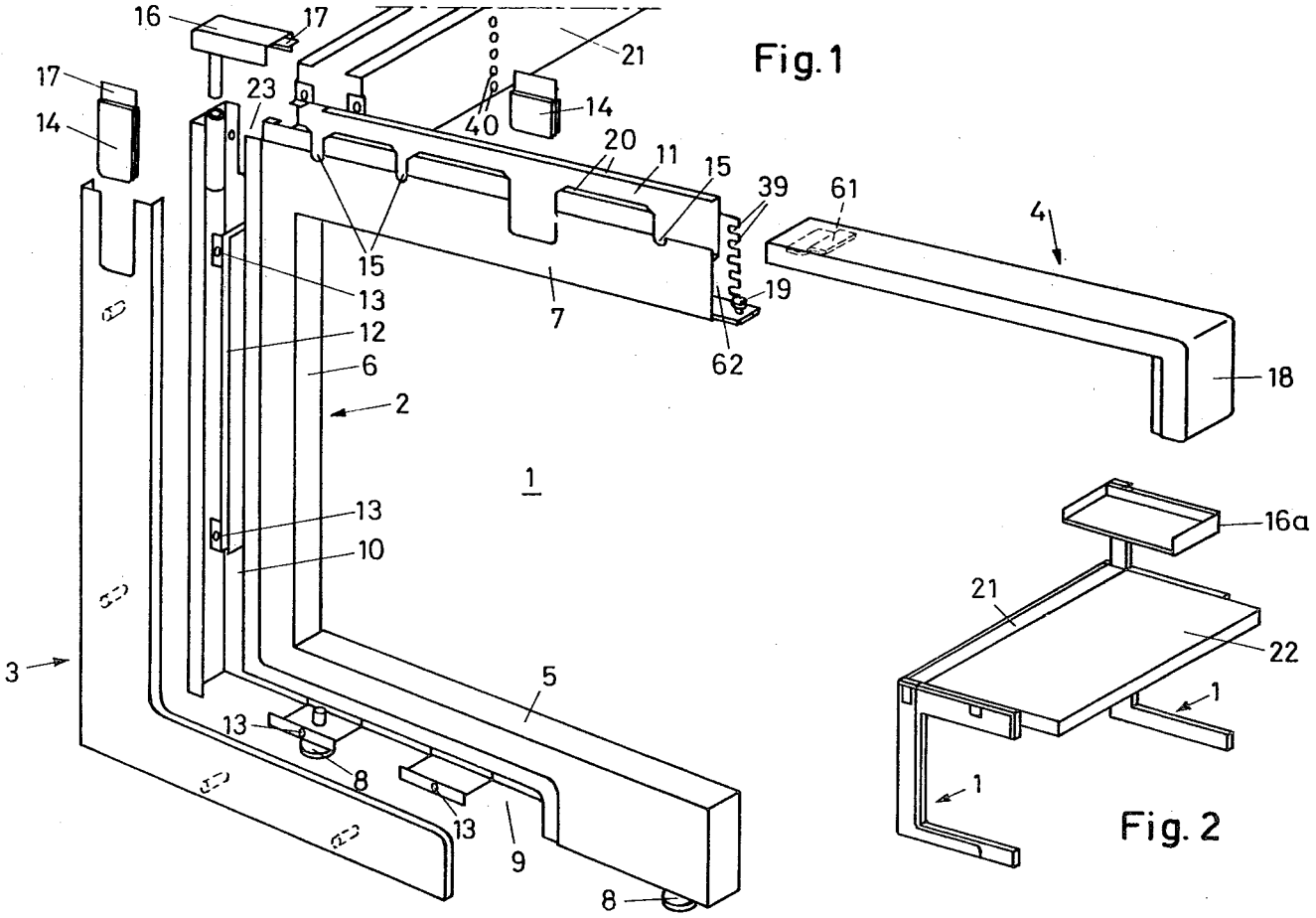
FIG. 1 represents a view in perspective of one lateral part and of one connective support in extended representation.
FIG. 2 is a view in perspective of an office desk.
Figure 3:
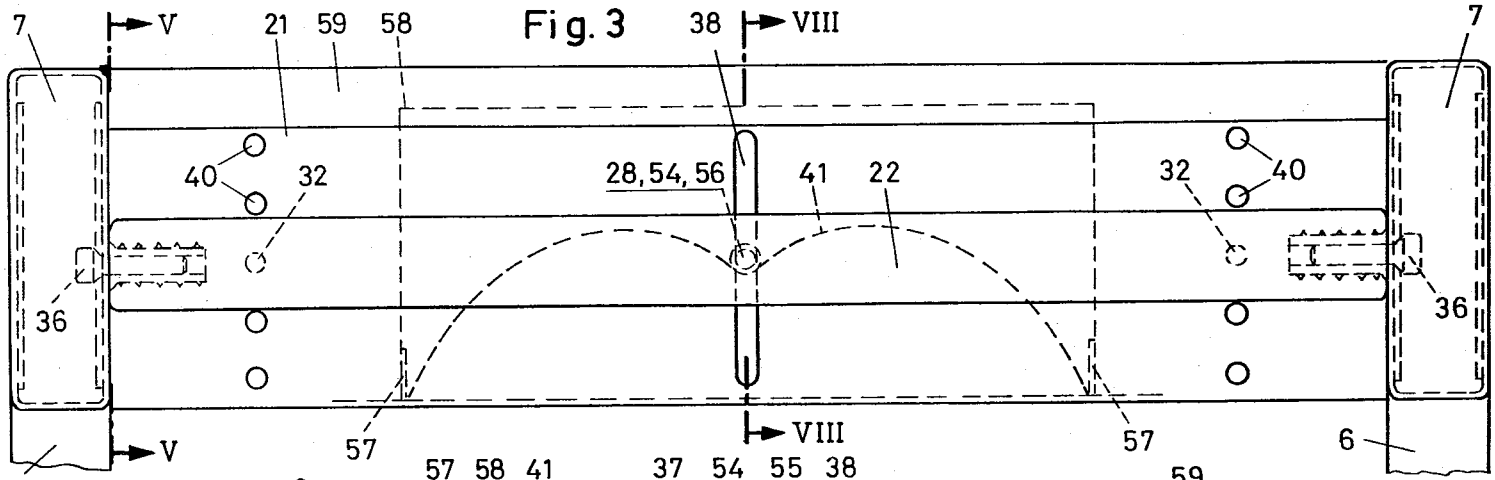
FIG. 3 is a view from the front upon the top part of the office desk according to FIG. 2, on an enlarged scale, and without the plug-in unit.
Figure 5:
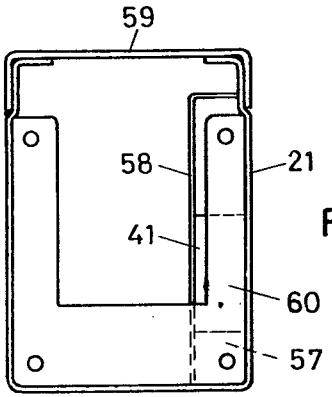
FIG. 5 is a front view upon the end of the connective support.
Figure 4:
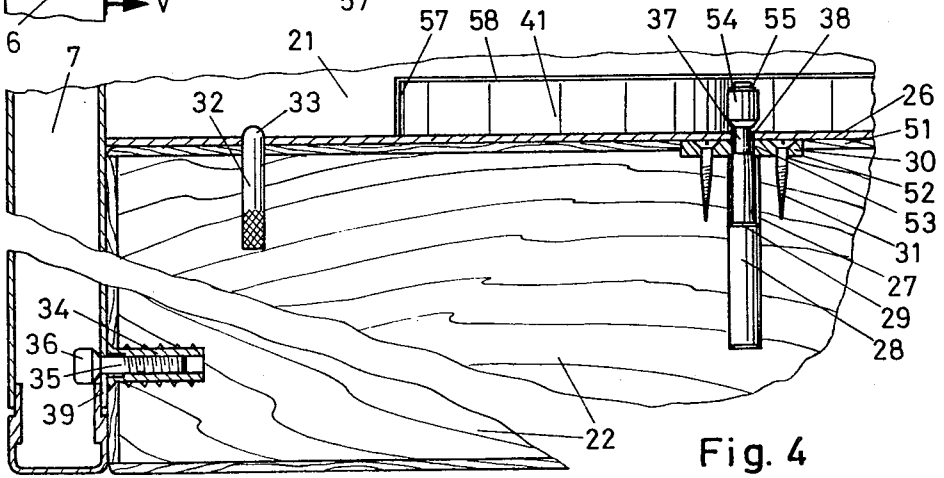
FIG. 4 is a view from the top on part of the office desk, sectioned according to FIG. 3.

The lateral part 1 represented in FIG. 1 in perspective is made of sheet metal and forms the principal element of an office furniture system for an efficient design of a working station. The lateral part 1 comprises a U-shaped core element 2 as well as lateral and upper cover panels 3 and/or 4.

The principal element 2 is designed as a partly open hollow profile, with the lower leg of the "U" forming the leg of the office furniture (leg 5). The leg 5 transcends into a vertical supporting column 6 from which a carrier arm 7 protrudes horizontally. The carrier arm 7 is the second leg of the "U". Vertically adjustable supporting screws 8 are arranged at the leg 5 in a manner known per se from prior art.

One side of the leg 5 has a downwardly open recess 9. The supporting column 6 likewise is provided laterally with a vertically extending aperture 10. Finally, the carrier arm 7 has on top a slot-like recess 11 through which its interior area is accessible from the top.

The recesses in the core element 2 permit in a simple manner the insertion of electrical cables and signal conduits without loops into the lateral part 1. The subdivision 12 of the inner duct 10 of the supporting column 6 is used to separate the electric conduits having high voltage from the signal conduits of low voltage.

Following the pulling in of the cables and/or conduits, it is possible to cover the lateral openings in the leg 5 and in the supporting column 6 by the L-shaped cover panel 3.

The cover panel 3 is connected via snap-in pins and snap holding means 13 to the core element 2 and thus can simply be pressed on to the latter.

A slide 14 inserted on top in the lateral cover panel 3 can be removed if additional units of furniture are to be added at the lateral part. By removing the slide 14 the access to the conduits and cables in the interior of the core piece 2 is exposed so that these conduits etc. can be pulled into the second piece of furniture without any problem. A removable slide is likewise arranged in the supporting arm 7 and serves the same purpose.

The additional units of furniture are fastened in a manner not shown in detail via clamping screws, which are inserted into the grooves 15 which are open on top, at the core element 2 of the lateral part 1. Because of the slides 14 the current and signal cable connections can be placed invisibly from the outside in the piece of furniture.

The supporting column 6 is provided with a sealing cover 16 which covers a protruding flap 17 of the slide 14 of the cover panel 3 and thus secures it against unauthorized removal. The sealing cover 16 in turn is likewise provided with a flap 17 which grips beneath the upper covering 4, so that the sealing cover 16 can be removed only following removal of the upper covering 4. It would be possible to mount in place of the sealing cover 16, a plugable unit, for example, a lamp or a standardized element **16*a*** on the supporting column.

To seal the carrier arm 7, the upper covering 4 is inserted from the forefront of the carrier arm until it snaps with its end 18 into a snap fastening means 19 at the forefront of the carrier arm 7. The covering means 4 grips with a flap 61 into the inwardly protruding rails 20 and is guided through the latter. As a result of the upper covering means 4, the slides 14, the sealing cover 16 or a corresponding plugable unit as well as possibly present clamping screws are secured in the grooves 15. In addition, the lateral engagement pins in the table top are likewise held firmly in a manner to be described as yet.

To build up the desk, two lateral parts 1, one upper connecting support 21 and one table top 22 are needed (FIG. 2). The connective support 21 sealed by a covering profile 59 is designed as a U-profile and has at both ends a flange 60 which is pushed against the supporting columns of the lateral parts and connected to them by means of screws. The upper inner lateral apertures 23 in the supporting columns expose the access to the inner area of the support 21, so that it is possible again to pull in electrical cables and signal conduits. The design of the inner area of the support is such that electrical receptacles and distribution boxes can be installed without any problem.

The table top 22 is made from wood which is coated for example with a veneer 50 or with plastic and framed by marginal strips 51. A perforation 27 is applied in the center at the posterior table top edge 26, a guide bolt 28 being positioned movably therein.

The bolt 28 is manufactured as one piece and as a rotary part, with the rear section having a larger diameter than the front section. The transition between the front and rear section forms a stop 29 which coacts with a metallic holding means 30.

With the assembly the bolt 28 first is pushed into the perforation 27 and the holding means 30 is fastened by means of the screws 31 at the table top edge 26. The holding means 30 is placed in a recess 52 and flush with the table top edge.

The bolt 28 can be pulled out only until the stop 29 hits against the holding means 30 whose perforation 53 is slightly larger than the diameter of the anterior bolt section, but smaller than the diameter of the posterior bolt section.

Each pin 32 with a protruding head 33 is anchored at both sides of the guiding bolt 28 in the rear edge 26 of the table top 22, for example by being glued into a perforation. Each bushing 34 is pounded in at the anterior area of the lateral table top edges, a threaded bolt 35 with protruding head 36 being screwed into said bushing.

For the mounting of the table top 22 first the protruding front end 37 of the movable bolt 28 is inserted into a vertical slot 38 in the connecting support 21. Subsequently, the head portion 54 is loosely pushed from the interior side of the connecting support upon the frontal end 37 and secured by means of a safety ring 55. Now the movable bolt 28 is held securely in the vertical slot. Now the table top 22 can be pulled forwardly until the stop 29 of the bolt 28 is seated at the holding means 30.

As the table top 22 is pushed rearwardly against the connecting support 21 the lateral bolt heads 36 are engaged into one of the engagement grooves 39 of the forefront of the supporting arm 7. At the same time the pin heads 33 of the rear edge 26 are pushed into one of the superimposed perforations 40 in the connecting support 21.

The head part 54 of the bolt 28 rests in a leaf spring 41 accomodated in the interior of the support 21, and thus compensates for part of the weight of the table top.

The oblong leaf spring 41 which is oblong in unloaded condition (FIG. 6) has a central recess 56 in which the head part 54 comes to rest. The spring is inserted loosely into the interior of the connecting support 21 and then tensioned arcuate-like between two terminal stops 57. The lateral holding of the spring 41 is assured by a panel 58. As shown from FIGS. 8 to 10, the table top can be adjusted vertically and/or angularly in a simple manner. To do this, first the upper coverage means 4 is disengaged and pushed slightly forward, in order to release the grooves 39 in the carrier arm 7. Then the table top can be pulled forward until it is disengaged completely and only suspended via the movable bolt 28 at the support 21, with the leaf spring 21 bearing part of the weight of the table top. It is impossible to erroneously release the table top because the bolt head 54 grips behind the vertical slot.

Now the table top is placed into the desired height and tilt and then pushed again rearwardly, so that it will again engage laterally and in the rear. Finally, the upper covering means 4 of the supporting arms 7 is pushed in again to secure the lateral engagement pins. FIGS. 8 to 10 show three different possibilities of adjustment.

The office furniture unit according to the invention assures a measure of system flexibility which heretofore has not been attained. The design and the linkage members can be mounted and again be removed with a few manipulations. Besides the vertical adjustability, the table tops also can be inclined forwardly with a few, but important degrees, a factor which industrial medicine considers as very favorable.

It also is possible to replace the table tops without screws in a matter of seconds, in order to adapt working stations to new requirements. Different plug-on units, like manuscript holders, telephones and letter tray assemblies, as well as lighting fixtures for operating stations, can be plugged on rapidly on the supporting column and/or the connecting duct. Signal cables and electric conduits can always be introduced into the unit of furniture without any problems and they are invisible from the outside.

For example, it also is possible to plug extensions in the front into the supporting arm. For that purpose, the interior area of the supporting arm is subdivided, with the duct 62 being used as a guide means for a profiled part which forms part of the extension. In this variant of an embodiment the cover means 4 also must be designed longer and/or the end 18 would have to be eliminated.

Selectively, it is possible to suspend or attach containers in the piece of furniture or push them beneath the piece of furniture as containers with pivotal rollers.

The item of furniture permits in a simple manner the designing of individual or multiple person offices, as well as of functional areas or office scenery.

We claim:

1. A furniture unit with an adjustable table top which is arranged between two lateral surfaces interconnected by an upper support, characterized by the fact that protruding pins (35, 33) are anchored in the posterior and lateral edges (26) of the table top (22), each of said pins being engaged in one of several superimposed recesses (39, 40) in the support (21) in a removable manner, and that a bolt (28) positioned for reciprocal movement and located in the rear edge of the table top is disposed in and with its head (54) protruding from a vertical slot (38) of the support (21), so that during disengagement of the top for its adjustment, it remains suspended over the bolts (28) in the support (21).

2. The furniture item as defined in claim 1, characterized by the fact that the bolt (28) is fastened in a perforation (27) in the posterior edge (26) of the top (22) and can be pulled out of the top as far as a stop (29).

3. The furniture item as defined in claim 2, whereby the bolt (28) is secured by a holding means (30) coacting with the stop (29) and fastened at the edge of the table top (26).

4. The furniture item as defined in claim 1, characterized by the fact that the head (54) of the bolt (28) is pushed on the protruding end of the bolt shaft and secured by means of a safety member (55).

5. The furniture item as defined in claim 1, characterized by the fact that the head (54) of the bolt (28) adheres to a spring (41) accommodated in the interior of the support (21) and the bolt neck is guided in the vertical slot (38) of the support (21).

6. The furniture item as defined in claim 1, characterized by the fact that each lateral part (1) of the item of furniture is provided with a forwardly protruding supporting arm (7) with grooves (39) open on one side and arranged superimposed being placed in the forefront of said arm for accommodating the protruding pins (35), and the lateral part (1) bears a removable coverage (4) which secures the pins (35) in the grooves (39).

7. The furniture item as defined in claim 1, characterized by the recesses (21) in the support (21) being superimposed perforations (40) arranged on both sides of the vertical slot (38).

8. The furniture item as defined in claim 5, characterized by the fact that the spring (41) is a leaf spring with a central recess (56) for accommodating the head portion and that the spring elongated in unbiased condition is inserted loosely in the support (21) and biased arcuately between two terminal stops (57).

* * * * *